US009297100B1

(12) United States Patent
Wu

(10) Patent No.: US 9,297,100 B1
(45) Date of Patent: Mar. 29, 2016

(54) SIX-NEEDLE EIGHT-THREAD STITCH CONFIGURATION

(71) Applicants: Hsuan-Yi Wu, Bade, Taoyuan County (TW); Che-Hsign Wu, Taoyuan County (TW)

(72) Inventor: Jui-Yi Wu, Bade (TW)

(73) Assignees: Hsuan-Yi Wu, Bade (TW); Che-Hsign Wu, Taoyuan County (TW)

( * ) Notice: Subject to any disclaimer, the term of this patent is extended or adjusted under 35 U.S.C. 154(b) by 0 days.

(21) Appl. No.: 14/533,262

(22) Filed: Nov. 5, 2014

(51) Int. Cl.
*D05B 1/18* (2006.01)
*D05B 93/02* (2006.01)

(52) U.S. Cl.
CPC . *D05B 1/18* (2013.01); *D05B 93/02* (2013.01)

(58) Field of Classification Search
CPC ..... D05B 1/08; D05B 1/10; D05B 1/12; D05B 1/14; D05B 1/16; D05B 1/18; D05B 1/20; D05B 1/22; D05B 93/00
See application file for complete search history.

(56) References Cited

U.S. PATENT DOCUMENTS 1,353,554 A * 9/1920 Tate ..... D05B 93/00 112/435
1,934,328 A * 11/1933 Rubel ..... D05B 93/00 112/435
2,056,580 A * 10/1936 Le Vesconte ..... D05B 93/00 112/435
2,079,569 A * 5/1937 Christensen ..... D05B 93/00 112/426
5,359,950 A * 11/1994 Schellas ..... A41D 27/24 112/160
5,383,414 A * 1/1995 Winter ..... D05B 1/08 112/100
6,167,825 B1 * 1/2001 Marchetti ..... A41B 11/14 112/162
7,404,367 B2 * 7/2008 Yasuzawa ..... D05B 1/08 112/197
8,100,070 B2 * 1/2012 Boinais ..... B60N 2/58 112/441
8,220,401 B2 * 7/2012 Hayashida ..... D05B 1/02 112/100
8,316,785 B2 * 11/2012 Boinais ..... D05B 1/08 112/166
8,943,985 B2 * 2/2015 Hashimoto ..... D05B 1/10 112/165

* cited by examiner

*Primary Examiner* — Danny Worrell
(74) *Attorney, Agent, or Firm* — Alan D. Kamrath; Kamrath IP Lawfirm, P.A.

(57) ABSTRACT

A six-needle eight-thread stitch configuration includes six rows of threads (21-26) sewn to two adjoining portions (13, 14) respectively of two fabrics (11, 12). Each row of threads (21-26) tightens a top thread (3; 3') and a bottom thread (4; 4') respectively and extending sinuously on upper and lower sides of each adjoining portion (13, 14). Each row of threads (21-26) includes a plurality of upper loops (27) and a plurality of lower loops (28) respectively on the upper and lower sides of the adjoining portions (13, 14). The top thread (3; 3') extends through the upper loops (27) of each row of threads (21-26) and is fixed to the upper sides of the fabrics (11, 12). The lower thread (4; 4') extends through the lower loops (28) of each row of threads (21-26) and is fixed to the lower sides of the fabrics (11, 12).

6 Claims, 10 Drawing Sheets

SIX-NEEDLE EIGHT-THREAD STITCH CONFIGURATION

BACKGROUND OF THE INVENTION

The present invention relates to a six-needle eight-thread stitch configuration and, more particularly, to a six-needle eight-thread stitch configuration suitable for both of side-by-side stitch and overlap stitch of fabrics.

People have higher demands in articles due to advanced living standards. In addition to the aesthetic appearance of clothes involving styles, materials, and cutting, the engagement strengths of side-by-side stitch and overlap stitch of fabrics are important.

In a current four-needle six-thread overlap stitch structure, as shown in FIGS. 1 and 2, four rows of threads 93 are sewn to adjoining portions respectively of two fabrics 91 and 92 and are spaced from each other in a transverse direction. Each row of threads 93 includes a plurality of upper loops 96 for tightening a top thread 94 extending sinuously on upper sides of the adjoining portions of the fabrics 91 and 92. Each row of threads 93 further includes a bottom thread 95 extending sinuously on lower sides of the adjoining portions of the fabrics 91 and 92. The bottom thread 95 extends through and is fixed in each bottom loop 97. Thus, an overlap stitch structure is formed. However, the engagement strength of the fabrics 91 and 92 sewn by the four-needle six-thread overlap stitch is limited and cannot fulfill special needs of various clothes.

Furthermore, the four-needle six-thread overlap stitch is not suitable for a side-by-side stitch structure. Specifically, when two fabrics 91 and 92 are placed side by side for side-by-side stitch (FIG. 3), only two rows of threads 93 are sewn to each fabric 91, 92 for tightening the top threads 94 and the bottom threads (not shown). The engagement strength of the side-by-side stitch is obviously insufficient.

Thus, it is an important issue to solve the above disadvantages.

BRIEF SUMMARY OF THE INVENTION

An objective of the present invention is to provide a six-needle eight-thread stitch configuration for sewing two fabrics to reliably form either a side-by-side stitch structure or an overlap stitch structure while increasing the engagement force and the tensile force of the stitch configuration of the fabrics, improving the quality of the clothes formed by the fabrics and prolonging the service life of the clothes.

To fulfill the above objective, the present invention provides a six-needle eight-thread stitch configuration including six rows of threads sewn to two adjoining portions respectively of two fabrics. The six rows of threads are spaced from each other in a transverse direction perpendicular to the six rows of threads. Each of the six rows of threads tightens a top thread extending sinuously on an upper side of each of the two adjoining portions in a length direction perpendicular to the transverse direction. Each of the six rows of threads tightens a bottom thread extending sinuously on a lower side of each of the two adjoining portions in the length direction. Each of the six rows of threads includes a plurality of upper loops on the upper sides of the two adjoining portions and a plurality of lower loops on the lower sides of the adjoining portions. The upper loops are spaced from each other and are alternately disposed. The plurality of lower loops are spaced from each other and are alternately disposed. The top thread extends through the upper loops of each of the six rows of threads and is fixed to the upper sides of the two fabrics. The lower thread extends through the lower loops of each of the six rows of threads and is fixed to the lower sides of the two fabrics.

In an example, the two adjoining portions respectively of the two fabrics are placed side by side, and each of the two adjoining portions has three of the six rows of threads, forming a side-by-side stitch structure.

In another example, the two adjoining portions are superimposed on each other, and each of the two adjoining portions has four of the six rows of threads, forming an overlap stitch structure.

In examples, the top thread extends sinuously and includes a left loop section and a right loop section. The left loop section includes a plurality of left loops arranged in the length direction. Each of the plurality left loops has two transverse sections spaced from each other in the length direction. A pair of transverse sections respectively of two adjacent left loops is placed side by side. The right loop section includes a plurality of right loops arranged in the length direction. Each of the plurality right loops has two transverse sections spaced from each other in the length direction. A pair of transverse sections respectively of two adjacent right loops is placed side by side. Each of the plurality of upper loops of three of the six rows of threads tightens a corresponding pair of transverse sections respectively of two adjacent left loops placed side by side. Each of the plurality of upper loops of the remaining three of the six rows of threads tightens a corresponding pair of transverse sections respectively of two adjacent right loops placed side by side.

The top thread can further include a plurality of slant sections. Each of the two transverse sections of each of the plurality of left loops is connected to one of the two transverse sections of one of the plurality of right loops by one of the plurality of slant sections.

In an example, the diameter of each of the top and bottom threads is larger than the diameter of each of the six rows of threads.

The present invention will become clearer in light of the following detailed description of illustrative embodiments of this invention described in connection with the drawings.

DETAILED DESCRIPTION OF THE INVENTION

Figure 1:
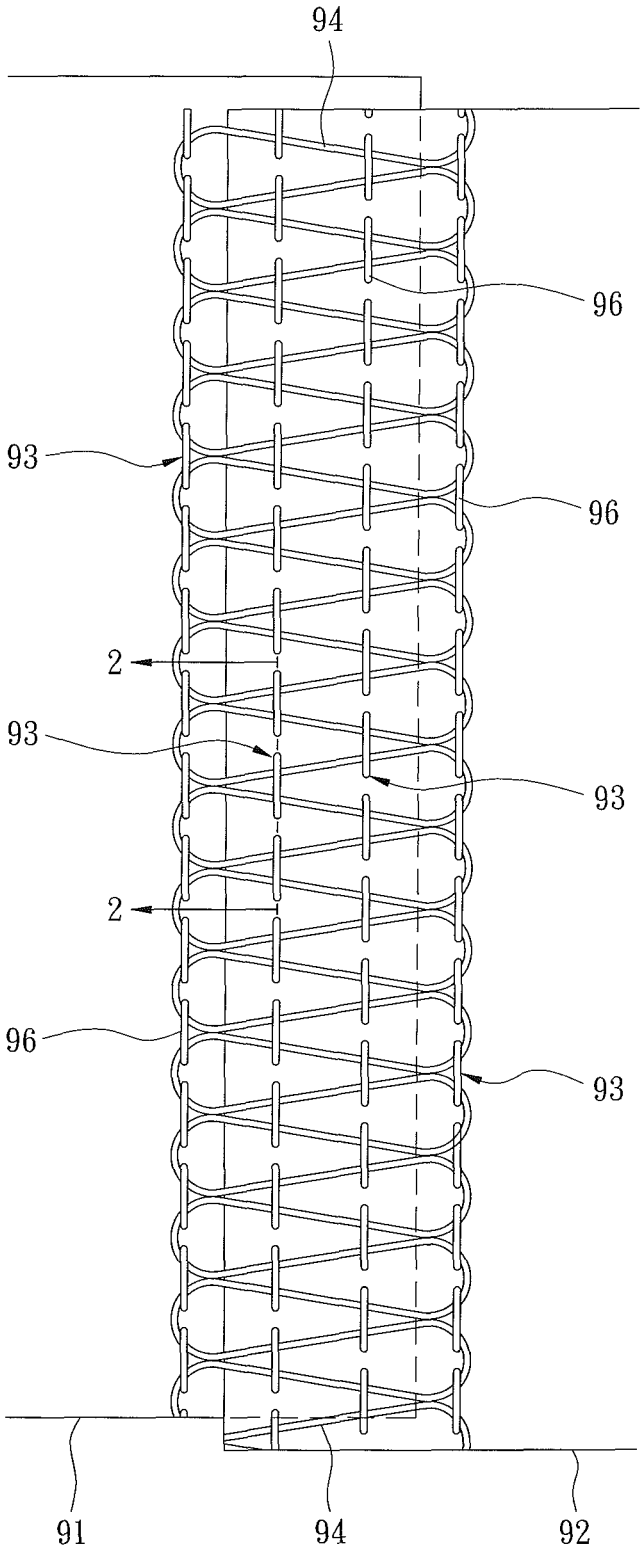
FIG. 1 PRIOR ART
FIG. 1 is a top view of a conventional four-needle six-thread overlap stitch structure.
Figure 2:
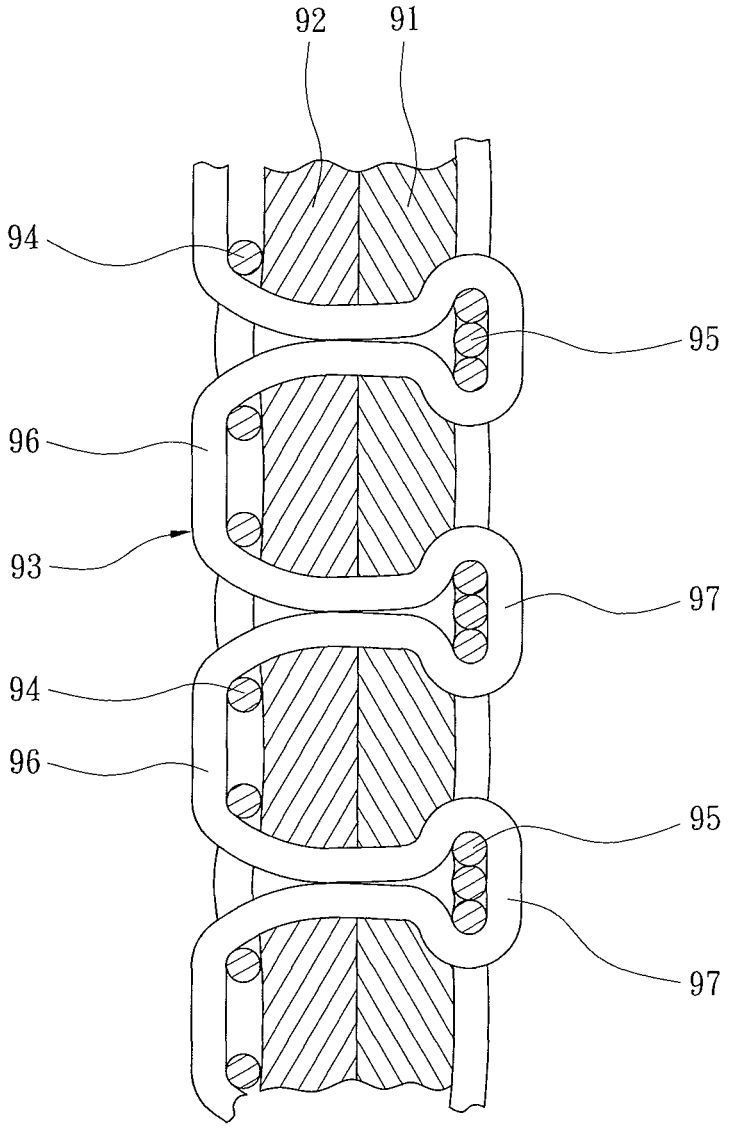
FIG. 2 PRIOR ART
FIG. 2 is a cross sectional view taken along section line 2-2 of FIG. 1.
Figure 3:
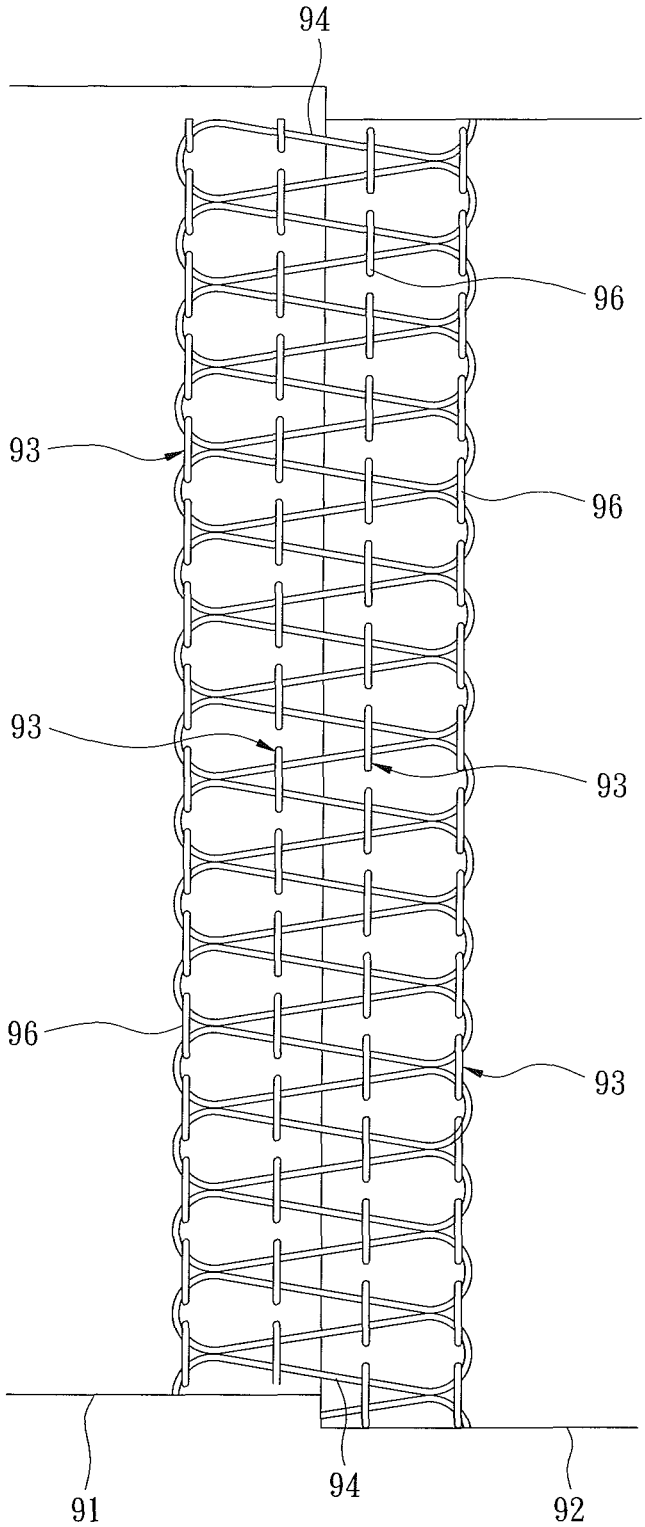
FIG. 3 PRIOR ART
FIG. 3 is a top view of a conventional four-needle six-thread side-by-side stitch structure.
Figure 4:
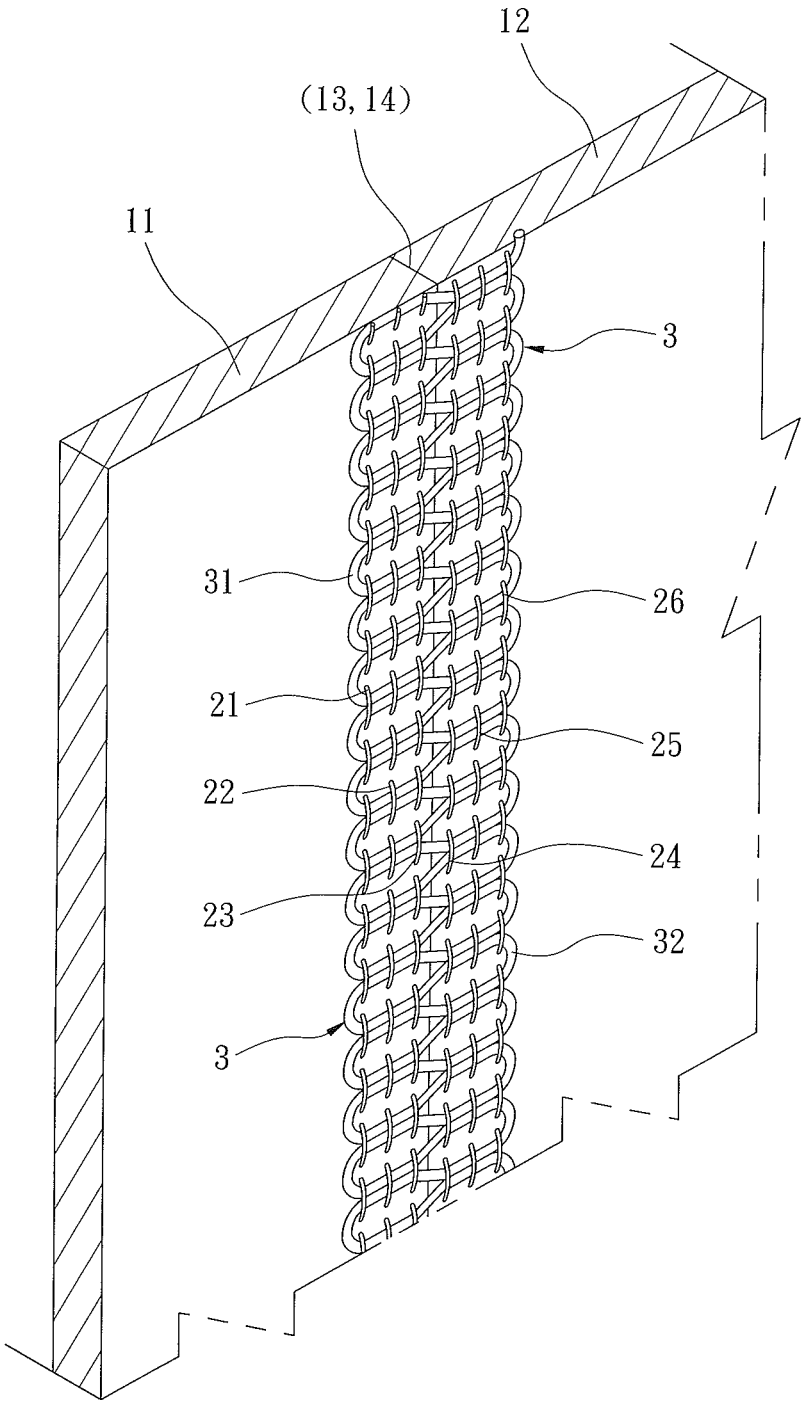
FIG. 4 is a perspective view of an example of a side-by-side stitch structure of a six-needle eight-thread stitch configuration according to the present invention.
Figure 5:
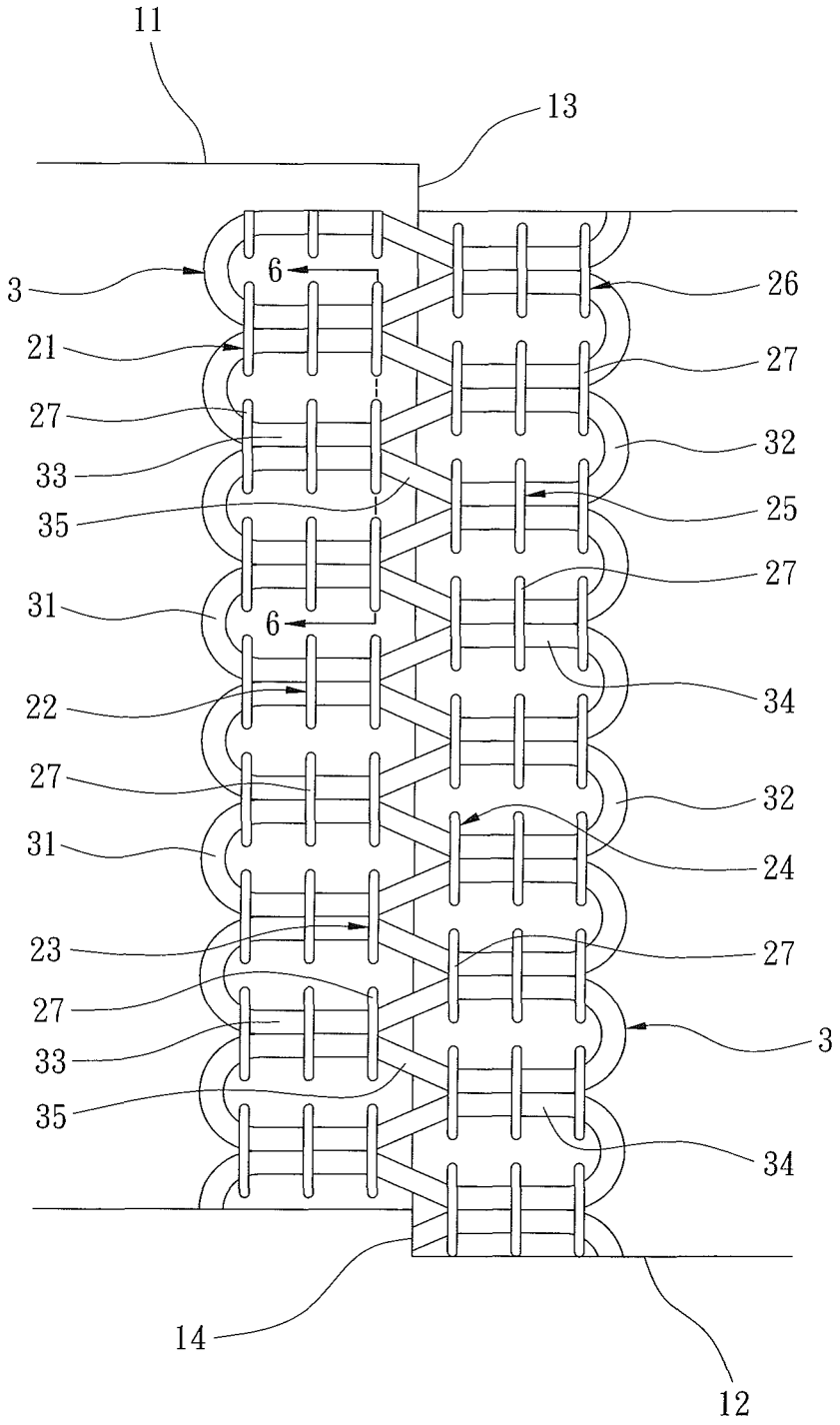
FIG. 5 is a partial, top view of the side-by-side stitch structure of the six-needle eight-thread stitch configuration of FIG. 4.
Figure 6:
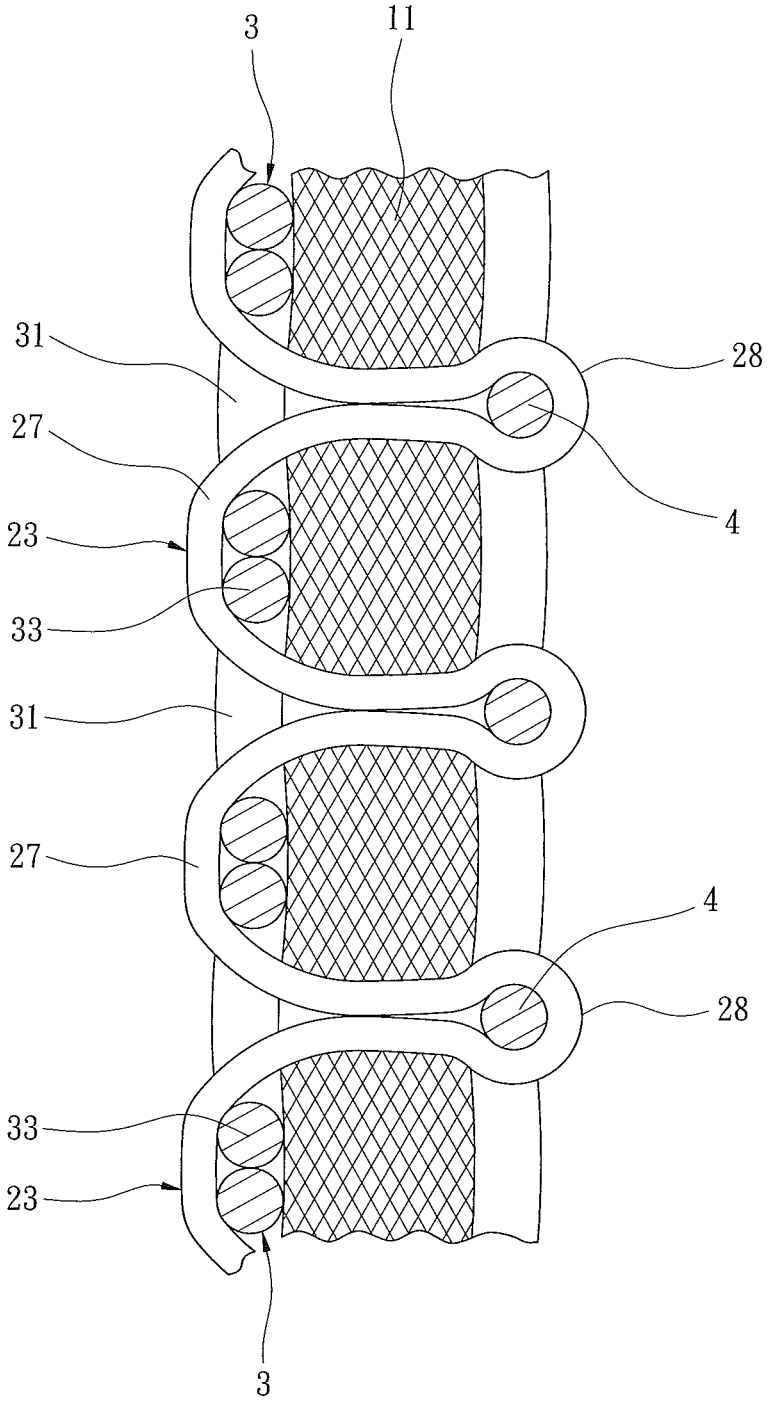
FIG. 6 is a cross sectional view taken along section line 6-6 of FIG. 5.

With reference to FIGS. 4-6, a six-needle eight-thread stitch configuration according to the present invention is suitable for two fabrics 11 and 12 in forming a side-by-side stitch structure. Furthermore, as can be seen from FIGS. 9 and 10, the six-needle eight-thread stitch configuration according to the present invention is also suitable for two fabrics 11 and 12 in forming an overlap stitch structure.

With reference to FIGS. 4-6, in the six-needle eight-thread stitch configuration according to the present invention, two adjoining portions 13 and 14 respectively of two fabrics 11 and 12 are placed side by side, and six rows of threads 21, 22, 23, 24, 25, and 26 are sewn to the adjoining portions 13 and 14. The six rows of threads 21, 22, 23, 24, 25, and 26 are spaced from each other in a transverse direction perpendicular to the six rows of threads 21, 22, 23, 24, 25, and 26. Each of the six rows of threads 21, 22, 23, 24, 25, and 26 tightens a top thread 3 extending sinuously on an upper side of each of the adjoining portions 13 and 14 in a length direction perpendicular to the transverse direction. Furthermore, each of the six rows of threads 21, 22, 23, 24, 25, and 26 tightens a bottom thread 4 extending sinuously on a lower side of each of the adjoining portions 13 and 14.

During the stitching procedure of the six-needle eight-thread stitch configuration, each of the six rows of threads 21, 22, 23, 24, 25, and 26 forms a plurality of upper loops 27 on the upper sides of the adjoining portions 13 and 14 and a plurality of lower loops 28 on the lower sides of the adjoining portions 13 and 14. The upper loops 27 are spaced from each other and alternately disposed. The lower loops 28 are spaced from each other and alternately disposed. The top thread 3 extend through the upper loops 27 of each of the six rows of threads 21, 22, 23, 24, 25, and 26 and is fixed to the upper sides of the two fabrics 11 and 12. The lower thread 4 extends through the lower loops 28 of each of the six rows of threads 21, 22, 23, 24, 25, and 26 and is fixed to the lower sides of the two fabrics 11 and 12. Thus, each adjoining portion 13, 14 has three of the six rows of threads 21, 22, 23, 24, 25, and 26. Furthermore, the fabrics 11 and 12 reliably form a side-by-side stitch structure, improving the engagement strength and the tensile strength of the stitch configuration.

Still referring to FIGS. 4-6, the diameter of each of the top and bottom threads 3 and 4 is larger than the diameter of each of the six rows of threads 21, 22, 23, 24, 25, and 26. Furthermore, the top thread 3 extends sinuously and includes a left loop section 31 and a right loop section 32. The left loop section 31 includes a plurality of left loops arranged in the length direction. Each left loop has two transverse sections 33 spaced from each other in the length direction. A pair of transverse sections 34 respectively of two adjacent left loops is placed side by side. The right loop section 32 includes a plurality of right loops arranged in the length direction. Each right loop has two transverse sections 34 spaced from each other in the length direction. A pair of transverse sections 34 respectively of two adjacent right loops is placed side by side. Each upper loop 27 of three of the six rows of threads 21, 22, 23, 24, 25, and 26 tightens a corresponding pair of transverse sections 33 respectively of two adjacent left loops placed side by side. Each upper loop 27 of the remaining three of the six rows of threads 21, 22, 23, 24, 25, and 26 tightens a corresponding pair of transverse sections 34 respectively of two adjacent right loops placed side by side. Furthermore, the top thread 3 further includes a plurality of slant sections 35. Each transverse section 33 of each left loop is connected to one of the transverse sections 34 of one of the right loops by one of the slant sections 35.

Figure 7:
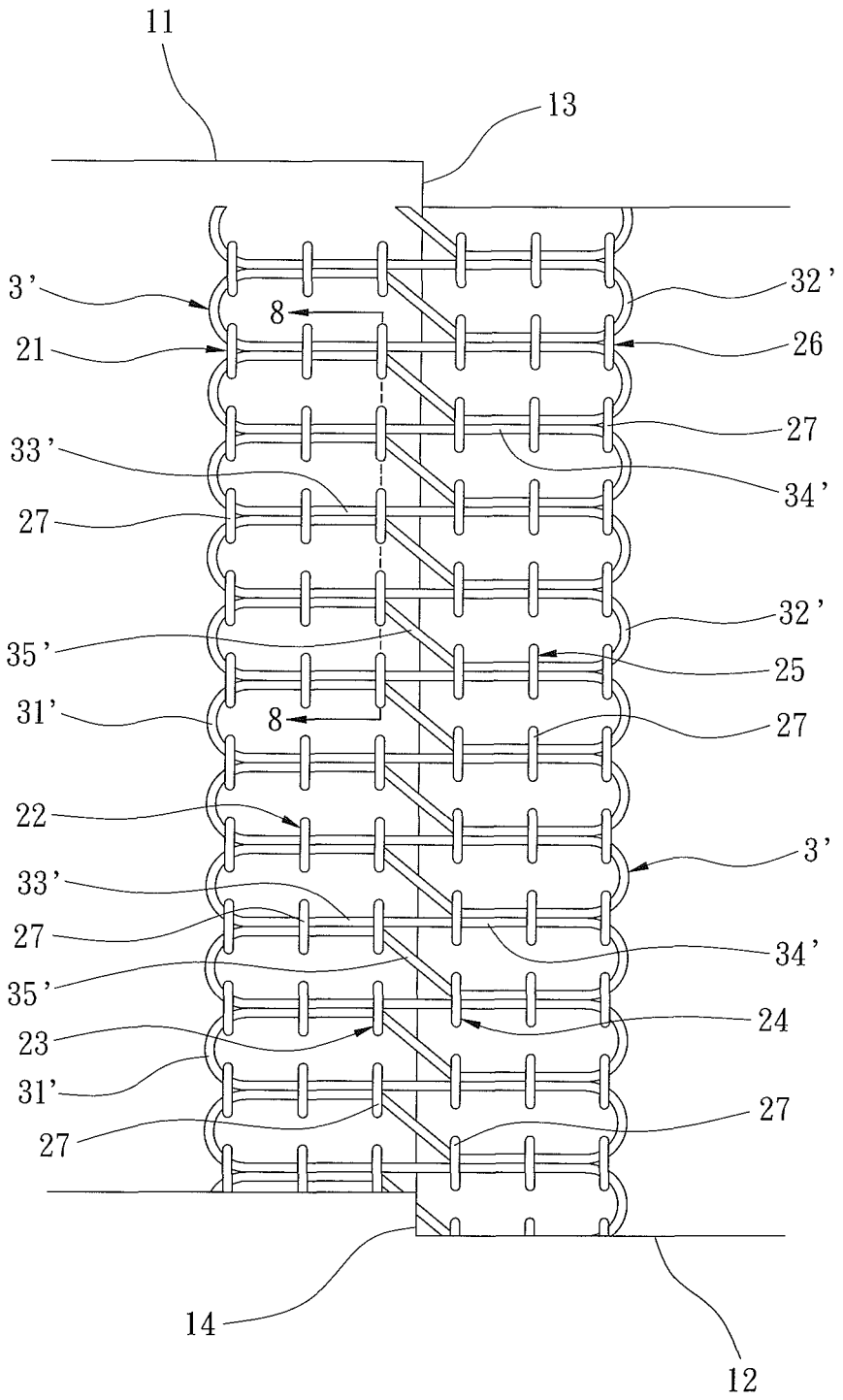
FIG. 7 is a partial, top view of another example of the side-by-side stitch structure of the six-needle eight-thread stitch configuration according to the present invention.
Figure 8:
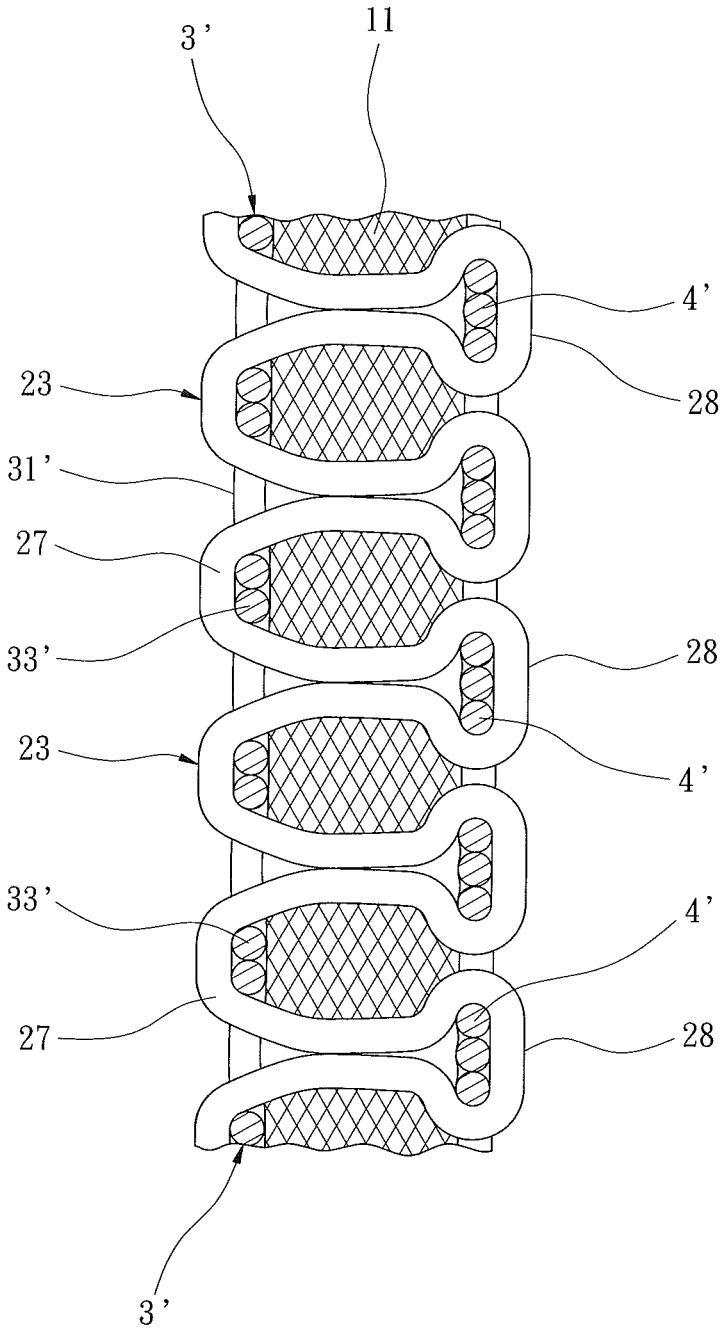
FIG. 8 is a cross sectional view taken along section line 8-8 of FIG. 7.

FIGS. 7-8 show another example of the side-by-side stitch structure of the six-needle eight-thread stitch configuration. Similar to the above example, six rows of threads 21, 22, 23, 24, 25, and 26, a top thread 3', and a bottom thread 4' are sewn to two fabrics 11 and 12. The top thread 3' extends sinuously and includes a left loop section 31', a right loop section 32', and a plurality of slant sections 35'. Each of a plurality of left loops of the left section 31' includes two transverse sections 33'. Each of a plurality of right loops of the right section 32' includes two transverse sections 34'. The main difference between this example and the above example is that the top thread 3', the bottom thread 4', and the six rows of threads 21, 22, 23, 24, 25, and 26 have the same diameter.

Figure 9:
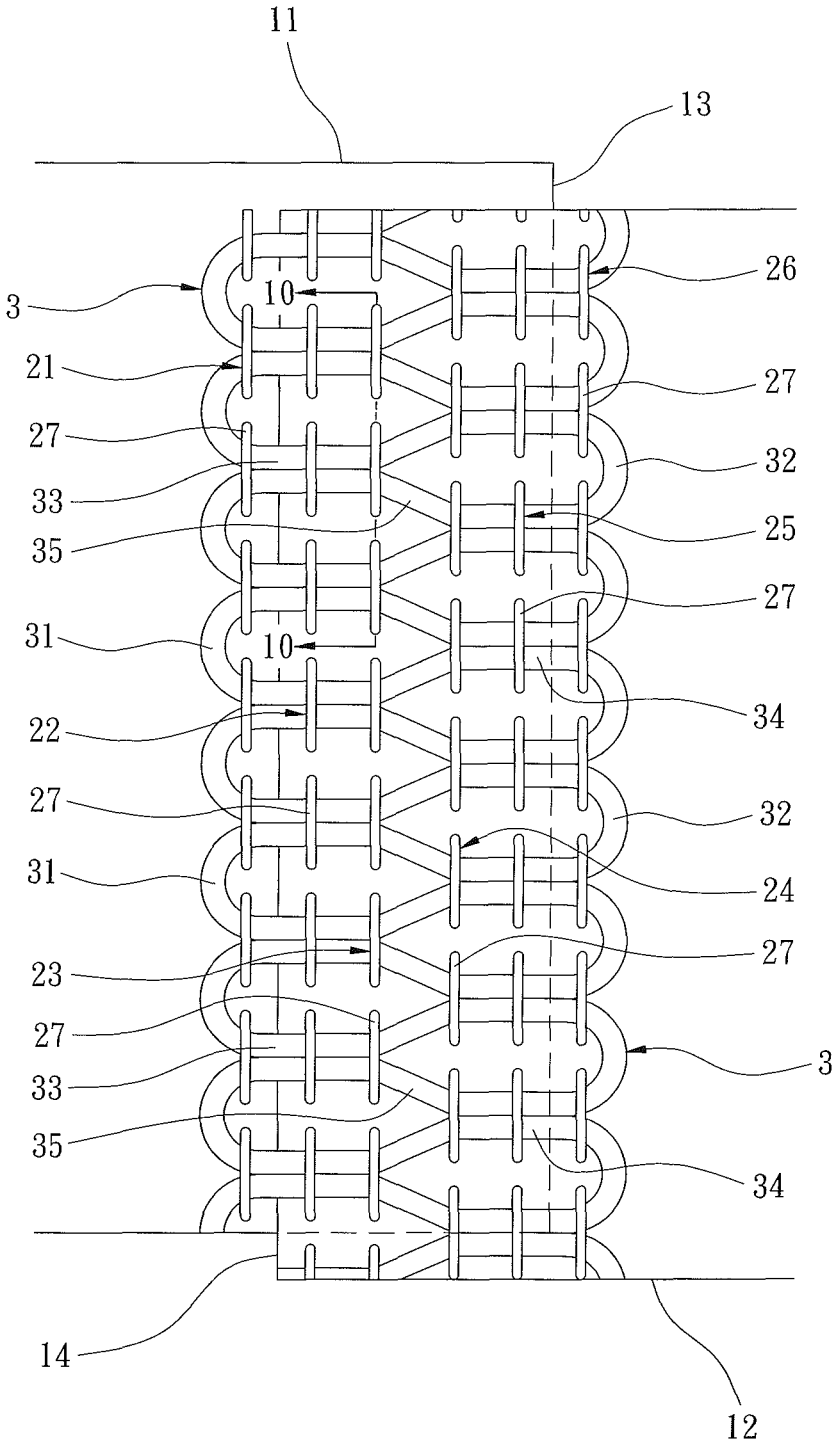
FIG. 9 is a partial, top view of an overlap stitch structure of the six-needle eight-thread stitch configuration according to the present invention.
Figure 10:
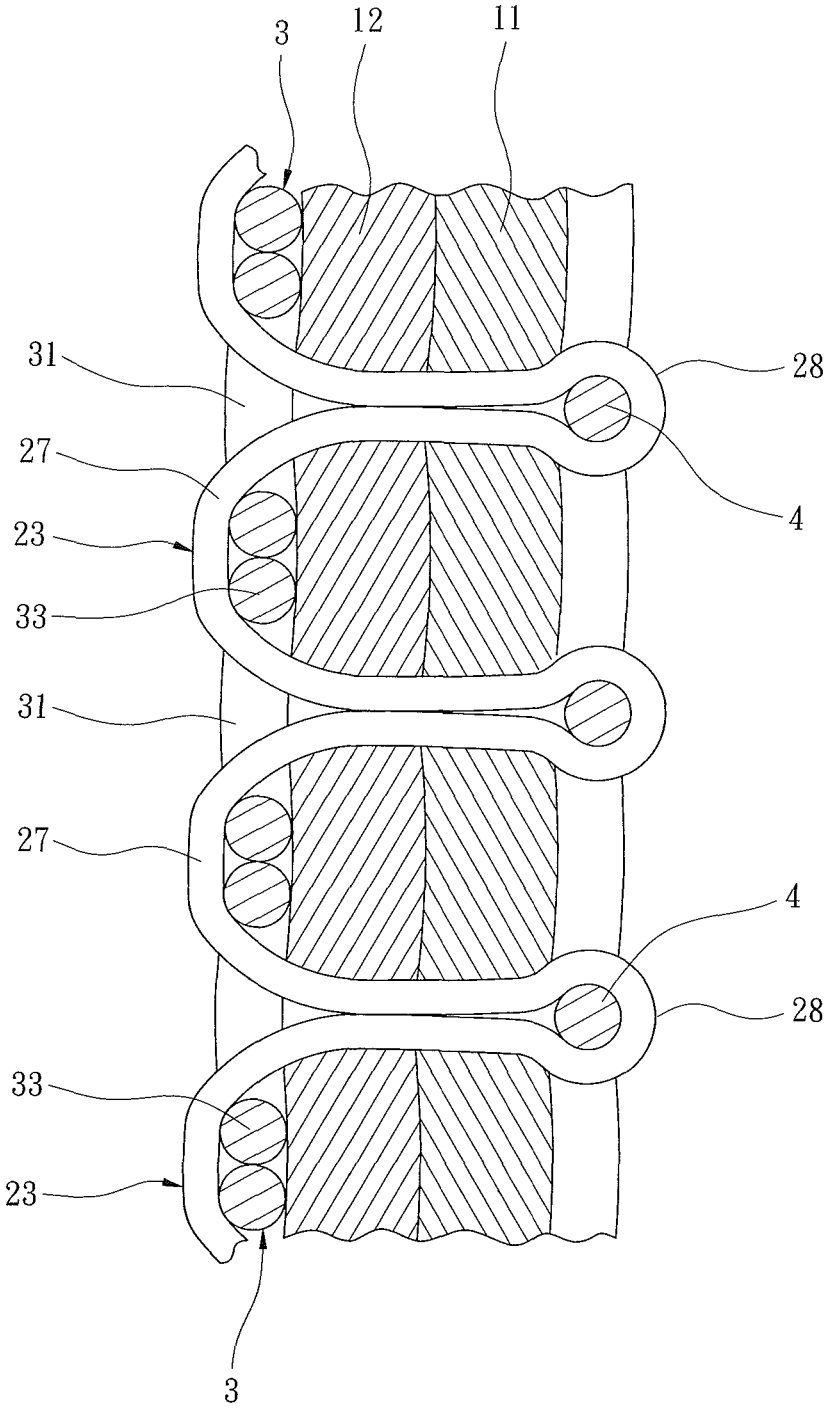
FIG. 10 is a cross sectional view taken along section line 10-10 of FIG. 9.

In the six-needle eight-thread stitch configuration shown in FIGS. 9 and 10, the adjoining portions 13 and 14 of two fabrics 11 and 12 are superimposed on each other. The fabrics 11 and 12 are sewn by six rows of threads 21, 22, 23, 24, 25, and 26, the top thread 3, and the bottom thread 4, such that each adjoining portion 13, 14 has four rows of threads 22, 23, 24, and 25. Thus, the fabrics 11 and 12 reliably form an overlap stitch structure, improving the engagement strength and the tensile strength of the stitch configuration.

Although specific embodiments have been illustrated and described, numerous modifications and variations are still possible without departing from the scope of the invention. The scope of the invention is limited by the accompanying claims.

The invention claimed is:

1. A six-needle eight-thread stitch configuration comprising six rows of threads sewn to two adjoining portions respectively of two fabrics, with the six rows of threads spaced from each other in a transverse direction perpendicular to the six rows of threads, with each of the six rows of threads tightening a top thread extending sinuously on an upper side of each of the two adjoining portions in a length direction perpendicular to the transverse direction, with each of the six rows of threads tightening a bottom thread extending sinuously on a lower side of each of the two adjoining portions in the length direction, with each of the six rows of threads including a plurality of upper loops on the upper sides of the two adjoining portions and a plurality of lower loops on the lower sides of the two adjoining portions, with the plurality of upper loops spaced from each other and alternately disposed, with the plurality of lower loops spaced from each other and alternately disposed, with the top thread extending through the plurality of upper loops of each of the six rows of threads and fixed to the upper sides of the two fabrics, with the lower thread extending through the plurality of lower loops of each of the six rows of threads and fixed to the lower sides of the two fabrics.

2. The six-needle eight-thread stitch configuration as claimed in claim 1, wherein the two adjoining portions respectively of the two fabrics are placed side by side, and wherein each of the two adjoining portions has three of the six rows of threads, forming a side-by-side stitch structure.

3. The six-needle eight-thread stitch configuration as claimed in claim 1, wherein the two adjoining portions are superimposed on each other, and wherein each of the two adjoining portions has four of the six rows of threads, forming an overlap stitch structure.

4. The six-needle eight-thread stitch configuration as claimed in claim 1, with the top thread extending sinuously and including a left loop section and a right loop section, with the left loop section including a plurality of left loops arranged in the length direction, with each of the plurality left loops having two transverse sections spaced from each other in the length direction, with a pair of transverse sections respectively of two adjacent left loops placed side by side, with the right loop section including a plurality of right loops arranged in the length direction, with each of the plurality right loops having two transverse sections spaced from each other in the length direction, with a pair of transverse sections respectively of two adjacent right loops placed side by side, with each of the plurality of upper loops of three of the six rows of threads tightening a corresponding pair of transverse sections respectively of two adjacent left loops placed side by side, with each of the plurality of upper loops of remaining three of the six rows of threads tightening a corresponding pair of transverse sections respectively of two adjacent right loops placed side by side.

5. The six-needle eight-thread stitch configuration as claimed in claim 4, wherein the top thread further includes a plurality of slant sections, and wherein each of the two transverse sections of each of the plurality of left loops is connected to one of the two transverse sections of one of the plurality of right loops by one of the plurality of slant sections.

6. The six-needle eight-thread stitch configuration as claimed in claim 4, wherein a diameter of each of the top and bottom threads is larger than a diameter of each of the six rows of threads.

* * * * *